US008621686B2

(12) United States Patent
McCullar et al.

(10) Patent No.: US 8,621,686 B2
(45) Date of Patent: Jan. 7, 2014

(54) POWER AND CONTROL SYSTEM FOR BED

(75) Inventors: Ricky J. McCullar, Olmsted Township, OH (US); Kristie L. Jarrett, Wakeman, OH (US)

(73) Assignee: Invacare Corporation, Elyria, OH (US)

( * ) Notice: Subject to any disclaimer, the term of this patent is extended or adjusted under 35 U.S.C. 154(b) by 305 days.

(21) Appl. No.: 12/833,441

(22) Filed: Jul. 9, 2010

(65) Prior Publication Data

US 2012/0005828 A1 Jan. 12, 2012

(51) Int. Cl.

| | |
|---|---|
| ***A47C 19/04*** | (2006.01) |
| ***A47B 7/02*** | (2006.01) |
| ***A47B 7/00*** | (2006.01) |

(52) U.S. Cl.

USPC ..... 5/412; 5/613; 5/616; 5/618; 5/619; 5/620

(58) Field of Classification Search

USPC ..... 5/613, 616, 618–620, 412

See application file for complete search history.

(56) References Cited

U.S. PATENT DOCUMENTS

| | | | | |
|---|---|---|---|---|
| 2,306,596 | A | 12/1942 | Despard | |
| 2,689,354 | A | 9/1954 | Sullivan | |
| 3,778,769 | A | 12/1973 | Hong et al. | |
| 3,781,927 | A | 1/1974 | Zakaras | |
| 3,913,153 | A | 10/1975 | Adams et al. | |
| 3,921,048 | A | 11/1975 | Padgitt | |
| 4,044,286 | A | 8/1977 | Adams et al. | |
| 4,095,296 | A * | 6/1978 | Ferro | 5/616 |
| 4,159,496 | A | 6/1979 | Stevens | |
| 4,227,269 | A | 10/1980 | Johnston | |
| 4,325,061 | A | 4/1982 | Wolar | |
| 4,403,214 | A | 9/1983 | Wolar | |
| 4,545,084 | A * | 10/1985 | Peterson | 5/618 |
| 4,833,377 | A | 5/1989 | Volk, Sr. et al. | |

(Continued)

FOREIGN PATENT DOCUMENTS

| | | |
|---|---|---|
| JP | 61115508 | 6/1986 |
| JP | 61115509 | 6/1986 |
| WO | 96/29970 | 10/1996 |
| WO | 2007/006314 | 1/2007 |

OTHER PUBLICATIONS

International Search Report and Written Opinion from PCT/US11/41585 dated Oct. 18, 2011.

(Continued)

*Primary Examiner* — William Kelleher
*Assistant Examiner* — Erica Kurilla
(74) *Attorney, Agent, or Firm* — Calfee, Halter & Griswold LLP

(57) ABSTRACT

Embodiments of a power and signal distribution assembly for a bed having at least one power input port, at least one controller port, and at least one output port are described. The power input port receives a first DC voltage from a power supply and the power supply receiving an AC voltage and converting it to the first DC voltage. The controller port receives the first DC voltage and outputs at least one power control signal having the first DC voltage. The output port receives signals having the first DC voltage. The power and signal distribution assembly has a first location and the power supply has a second location different from the first location. In other embodiments, the power and signal distribution assembly is located on a frame of a bed and the power supply remote therefrom. Still further, one or more additional controller ports may also be provided.

21 Claims, 4 Drawing Sheets

(56) References Cited

U.S. PATENT DOCUMENTS

| | | | | |
|---|---|---|---|---|
| 5,134,731 | A | 8/1992 | Quintile et al. | |
| 5,138,953 | A | 8/1992 | Horcher et al. | |
| 5,398,149 | A | 3/1995 | Weil | |
| 5,568,661 | A * | 10/1996 | Bathrick et al. | 5/618 |
| 5,704,249 | A | 1/1998 | Krauska | |
| 5,802,639 | A | 9/1998 | Raasch et al. | |
| 6,000,077 | A * | 12/1999 | Cyr | 5/618 |
| 6,105,187 | A * | 8/2000 | Gnjatovic | 5/618 |
| 6,851,144 | B2 * | 2/2005 | Wang | 5/610 |
| 6,983,495 | B2 | 1/2006 | Snyder et al. | |
| 6,997,082 | B2 | 2/2006 | Snyder et al. | |
| 7,040,637 | B2 | 5/2006 | Owens | |
| 7,093,312 | B2 * | 8/2006 | Mossbeck | 5/613 |
| 7,185,377 | B2 | 3/2007 | Roussy | |
| 7,232,962 | B2 | 6/2007 | Rynd | |
| 7,302,716 | B2 | 12/2007 | Snyder et al. | |
| 7,441,289 | B2 | 10/2008 | Loewenthal | |
| 7,610,637 | B2 | 11/2009 | Menkedick et al. | |
| 7,698,761 | B2 * | 4/2010 | Neuenswander et al. | 5/618 |
| 8,065,024 | B2 * | 11/2011 | Nagaoka et al. | 700/83 |
| 8,150,562 | B2 * | 4/2012 | Rawls-Meehan | 700/302 |
| 2002/0135492 | A1 | 9/2002 | Reagan et al. | |
| 2006/0230534 | A1 * | 10/2006 | Mossbeck | 5/618 |
| 2008/0262657 | A1 | 10/2008 | Howell et al. | |
| 2009/0050451 | A1 | 2/2009 | Sorensen et al. | |

OTHER PUBLICATIONS

Invacare Corporation, Parts Catalog for Homecare Beds (Manual, Semi-Electric, Full Electric), CareGuard by Invacare Bariatric Bed (Full Electric) issued Feb. 11, 2010, 76 pgs.

Invacare Corporation, Owner's Operator and Maintenance Manual, IVC Bed Series, Full Electric Beds, Semi-Electric Beds, Manual Beds, Revised Feb. 11, 2009, copyright 2010, 40 pgs.

Invacare Corporation, Invacare Home Care Beds and Bed-Related Products brochure, 12 pgs., copyright 2007.

* cited by examiner

POWER AND CONTROL SYSTEM FOR BED

The invention relates generally to beds and, more particularly, to beds having one or more power-assisted features. Such beds include one or more motors for adjusting one or more characteristics of the bed including, for example, the height of the bed above the floor, the position or angle of the head spring, and/or the position or angle of the foot spring. In this manner, such beds can provide the user with a multitude of bodily positions while they are in bed.

SUMMARY

In one embodiment, the present invention is directed to an power and signal distribution assembly having at least one power input port, at least one controller port, and at least one output port. The power input port receives a first DC voltage from a power supply and the power supply receiving an AC voltage and converting it to the first DC voltage. The controller port receives the first DC voltage and outputs at least one power control signal having the first DC voltage. The output port receives signals having the first DC voltage. The power and signal distribution assembly has a first location and the power supply has a second location different from the first location. In other embodiments, the power and signal distribution assembly is located on a frame of a bed and the power supply remote therefrom.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DESCRIPTION

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

Figure 1:
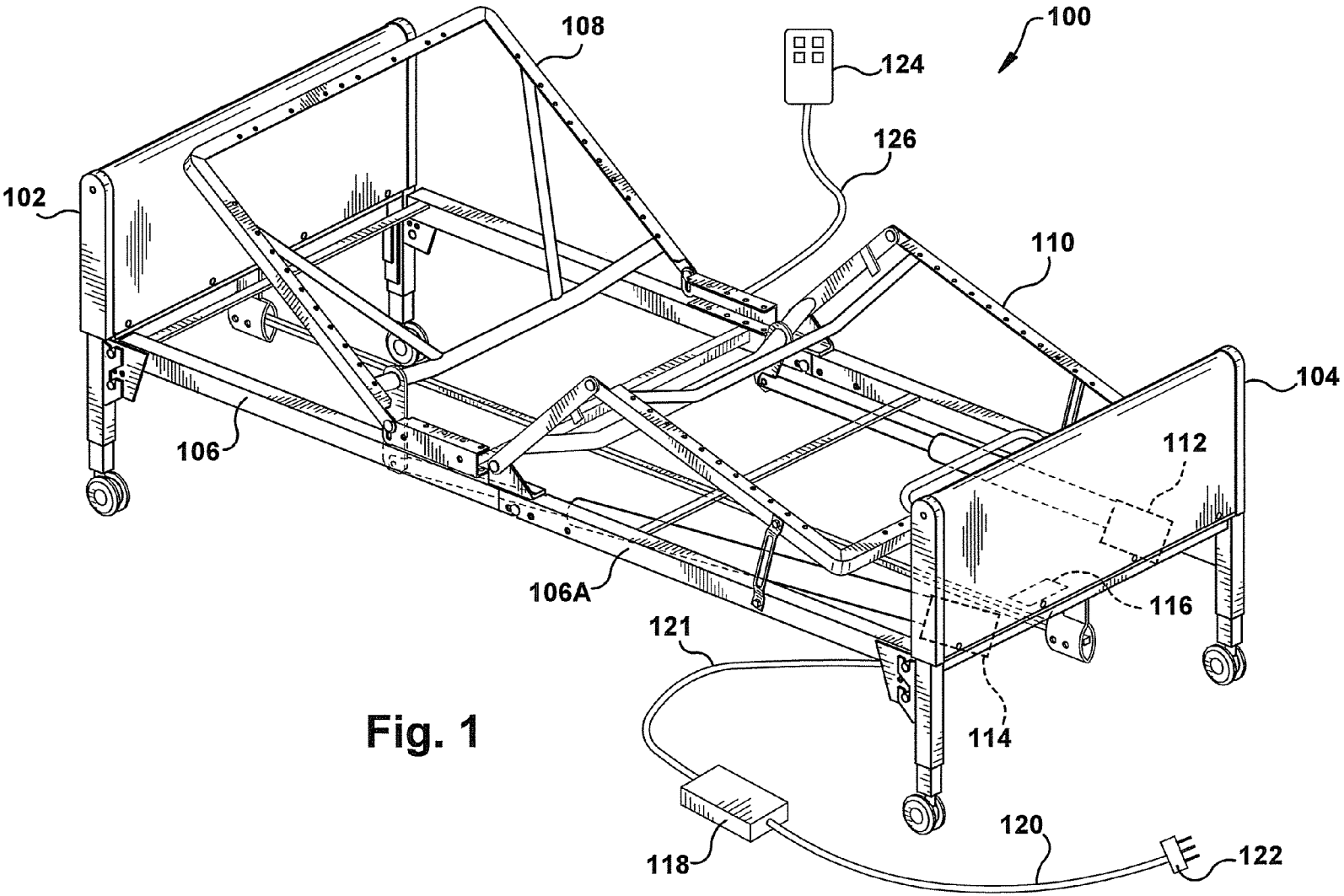
FIG. 1 is a perspective view of one embodiment of a bed system incorporating aspects of the present invention.

Referring to FIG. 1, a bed system 100 is illustrated. System 100 includes, for example, a bed having head and foot ends 102 and 104 that are joined by a frame designated by sections 106 and 106A. The head and foot ends can be of the type, for example, described in U.S. Pat. Nos. 6,983,495, 6,997,082, 7,040,637, 7,302,716, 7,441,289, which are hereby fully incorporated by reference. The head and foot ends 102 and 104 include mechanisms therein that allow for raising or lowering of frame 106 and 106A relative to the floor. In other embodiments, the frame may be formed from a single section collectively representing section 106 and 106A. The frame may also be formed by more than two sections.

System 100 further includes a head spring portion 108 and a foot spring portion 110 that are connected to the frame 106 and 106A. Head and foot spring portions 108 and 110 are connected to frame 106 and 106A in a manner that allows for the angular position of the head and foot spring portions 108 and 110 to be modified. In one embodiment, this connection is accomplished through pivoting joints. The angular position of head and foot spring portions 108 and 110 are modified to use the motor/actuators 112 and 114. The raising and lowering of frame 106 and 106A relative to the floor is accomplished through a high/low motor/drive shaft assembly 116 and gear assemblies on each of the head and foot ends 102 and 104.

Power is provided to system 100 through a power supply 118 and control is provided through a pendant controller 124. Power supply 118 includes a cable 120 having a plug 122 for connecting to a source of power such as, for example, a wall outlet. In one embodiment, power supply 118 converts a 90-240 V AC input signal to a 28 V DC output signal, or any other voltage signal, which is output on cable or bus 121. Pendant controller 124 receives its input and provides its output signals through cable or bus 126.

Figure 2:
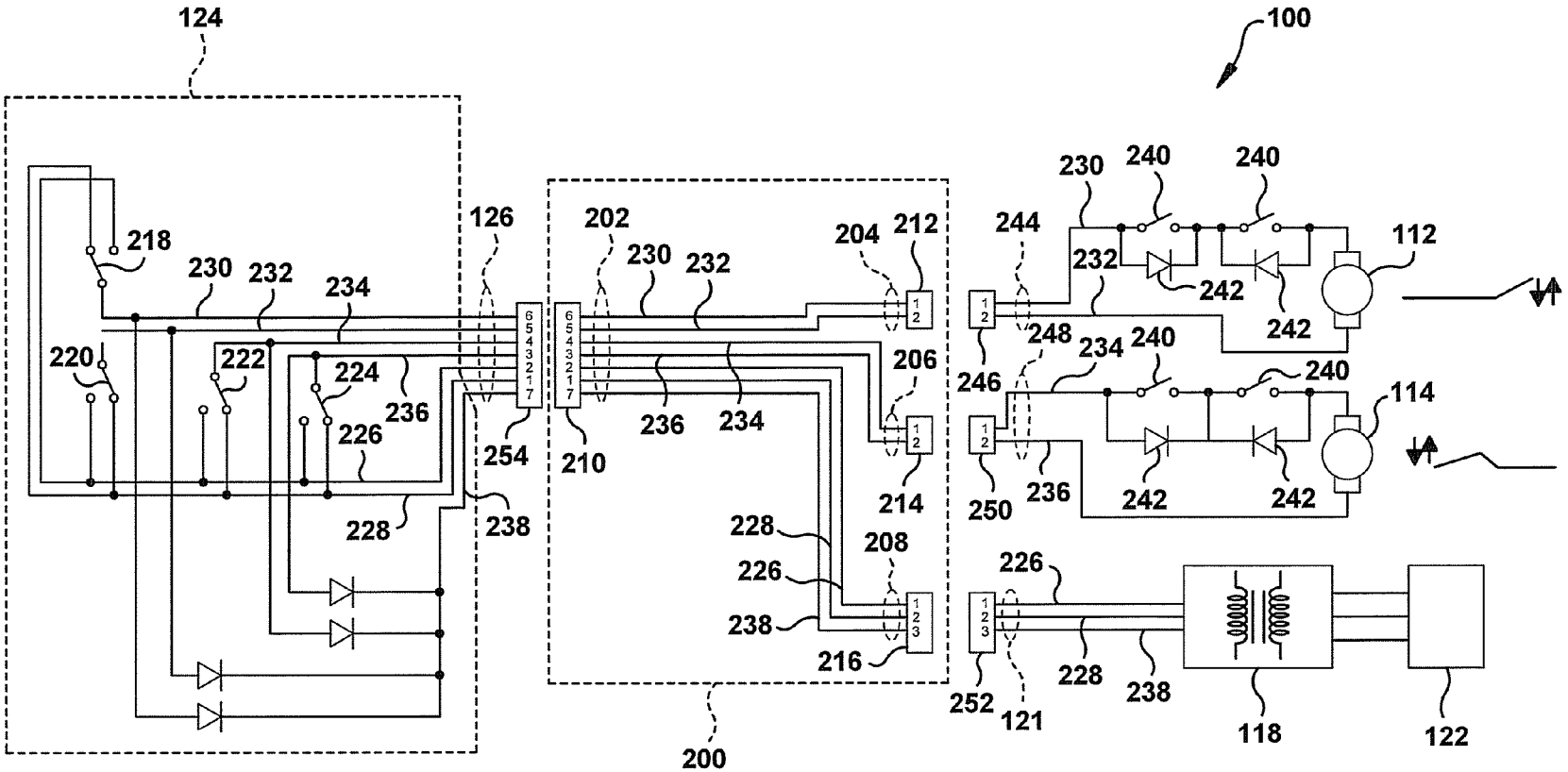
FIG. 2 is an electrical schematic of one embodiment of a power and control system of the present invention.

Illustrated in FIG. 2 is a schematic of one embodiment of a bed power and control system. This embodiment includes a power and signal distribution assembly 200 connecting various other components of the system together. Assembly 200 includes a plurality of buses 202, 204, 206, and 208. Assembly 200 further includes a plurality of ports 210, 212, 214, and 216. The ports are used for interfacing or connecting to power supply 118, motors/actuators 112 and 114, and pendant controller 124.

Pendant controller 124 includes a plurality of switches for controlling the various motors and actuators on the bed system. Switches 218 and 220 control the foot spring motor/actuator 112 to effect angular movement of the foot spring relative to the frame. Switches 222 and 224 control the head spring motor/actuator 114 to effect angular movement of the head spring relative to the frame. For example, switch 218 may control upward movement of the head spring and switch 220 may control downward movement of the head spring. Similarly, switch 222 may control upward movement of the foot spring and switch 224 may control downward movement of the foot spring.

Power from power supply 118 is provided via a power line 226 and a common line 228. An overload protection signal line 238 is also provided and inhibits power supply output during an overload protection event. After an overload protection event, signal line 238 must change from a high state to a low state to signal the power supply 118 to reset its internal protection circuit, which is responsible for inhibiting power output. In the current embodiment, overload protection signal line 238 is in its low state when all pendant button switches (e.g., 218, 220, 222 and 224) are released or in their open or non-power transmitting state (i.e., they are not driving any motor circuits). As illustrated, overload protection signal line 238 is connected to the pendent button switches through a plurality of diodes. As such, overload protection signal monitors the state of the pendent switches and indicates to power supply 118 that its overload protection circuit can be reset when none of the pendent button switches are being depressed.

As described previously, in one embodiment, power line 226 may represent a 28 V DC signal or any other voltage signal. Power line 226 and common line 228 are input into a power port 216 assembly 200 by connecting to the power port 252 of the power supply 118. In this manner, the power from power supply 118 is provided to the power bus 208 of assembly 200. Power bus 208 is a component of main bus 202 and assembly 200 and connects to assembly port 210. Assembly port 210 connects to pendant port 254 allowing power line 226 and common line 228 to be connected to switches 218 through 224. Hence, each switch 218 through 224 connects to either power line 226 or common line 228.

Switch 218 is further connected to signal line 230 which switches between outputting power line 226 or common line 228, depending on the switch position. Switches 220, 222, and 224 similarly include output signal lines 232, 234, and 236. The power level or polarity on signal lines 230 and 232 and signal lines 234 and 236 are output through pendant port 254 to assembly port 210 and continue on through main bus 202.

From main bus 202, signal lines 230 and 232 form a first motor/actuator control bus 204 and signal lines 234 and 236 form a second motor/actuator control bus 206. First and second buses 204 and 206 are connected to ports 212 and 214, which interface with motor/actuator ports 246 and 250. Motors/actuators 112 and 114 receive their control power from buses 244 and 248, respectively, which are connected to ports 246 and 250. Each motor/actuator includes a plurality of limit switches 240 and diodes 242 to effect proper operation based on the polarity of the signals on buses 244 and 248 and the position limits of the actuators In this manner, power and signal distribution assembly 200 includes a plurality of buses, each having an associated port therewith, for receiving power from power supply 118 and providing power and control signals to various components of the bed system including the pendant controller 124, foot spring motor/actuator 112, head spring motor/actuator 114. In this embodiment, power and signal distribution assembly 200 includes a main bus 202 that includes both power and control signals, a bus 204 including head spring motor/actuator power control signals, a bus 206 including foot spring motor/actuator power control signals, and a bus 208 including power and common signals. Each bus (202, 204, 206, and 208) includes a port (210, 212, 214, and 216) for providing access to these signals.

Further as shown in the present embodiment of FIGS. 1 and 2, power supply 118 is disposed at a first location not on bed frame 106 or any other component. According to this configuration, relatively high voltages and power such as those found in sources that provide power to power supply 118 (e.g., typical 90 to 130 V AC or 210 to 240 V AC wall outlets) are not brought to any component physically located at the bed. Instead, relatively low voltages such as 28 V DC output from the power supply 118 located away from the bed are provided to the bed. Fusing and other current limiting devices further limit the electrical exposure associated with the bed.

Power from distal power supply 118 is provided to power and signal distribution assembly 200, which is located on the bed. Therefrom, power and signal distribution assembly 200 distributes power and signal lines to pendant controller 124. Pendant controller 124, as the name implies, may be moved to a variety of locations with respect to the bed in order to allow a user to control the various movable components of the bed. Power and signal distribution assembly 200 further distributes power control signals from pendant 124 to motors/actuators 112 and 114 to control the head and foot spring portions of the bed.

Figure 3:
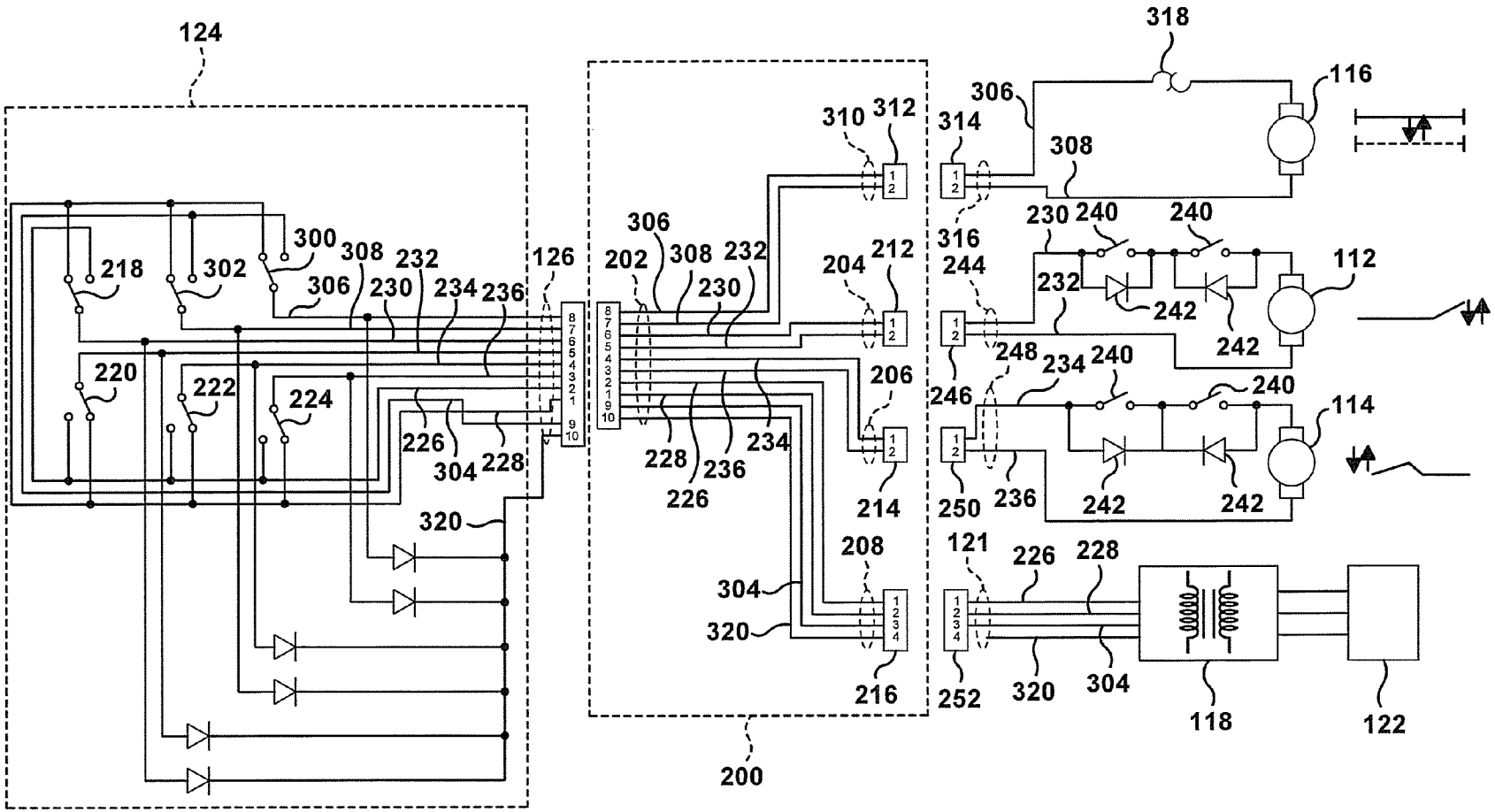
FIG. 3 is an electrical schematic of another embodiment of a power and control system of the present invention.

Referring now to FIG. 3, another embodiment of a bed power and control distribution system schematic similar to that of FIG. 2 is provided, except that it includes a motor/actuator for a high-low function of the bed 116 and a thermal protection circuit 318. The high-low function of the bed adjusts through a motor/actuator the height of frame 106 and 106A of the bed relative to the floor. As such, pendant controller 124 include switches 300 and 302 for controlling the upward and downward movement of frame 106 and 106A. The output of switches 300 and 302 are provided on signal lines 306 and 308. Since high-low motor/actuator 116 or any other motor/actuator may run on a different power requirement than other actuators being controlled by pendant controller 124, a separate power line 304 providing, for example, a higher current and/or voltage capacity, may be provided. An overload protection signal line 320 is also provided and operates in the same manner as overload protection signal line 238 of FIG. 2.

Power and signal distribution assembly 200 may be modified to include bus 310 and port 312 for the high-low power control signals 306 and 308. Port 314 connects to port 312 provides power control signals 306 and 308 motor/actuator 116. Hence, compared to the embodiment of FIG. 2, the embodiment of power and signal distribution assembly 200 of FIG. 3 includes an additional port for the high-low function of the bed. More or less output ports may be used in other embodiments.

Figure 4:
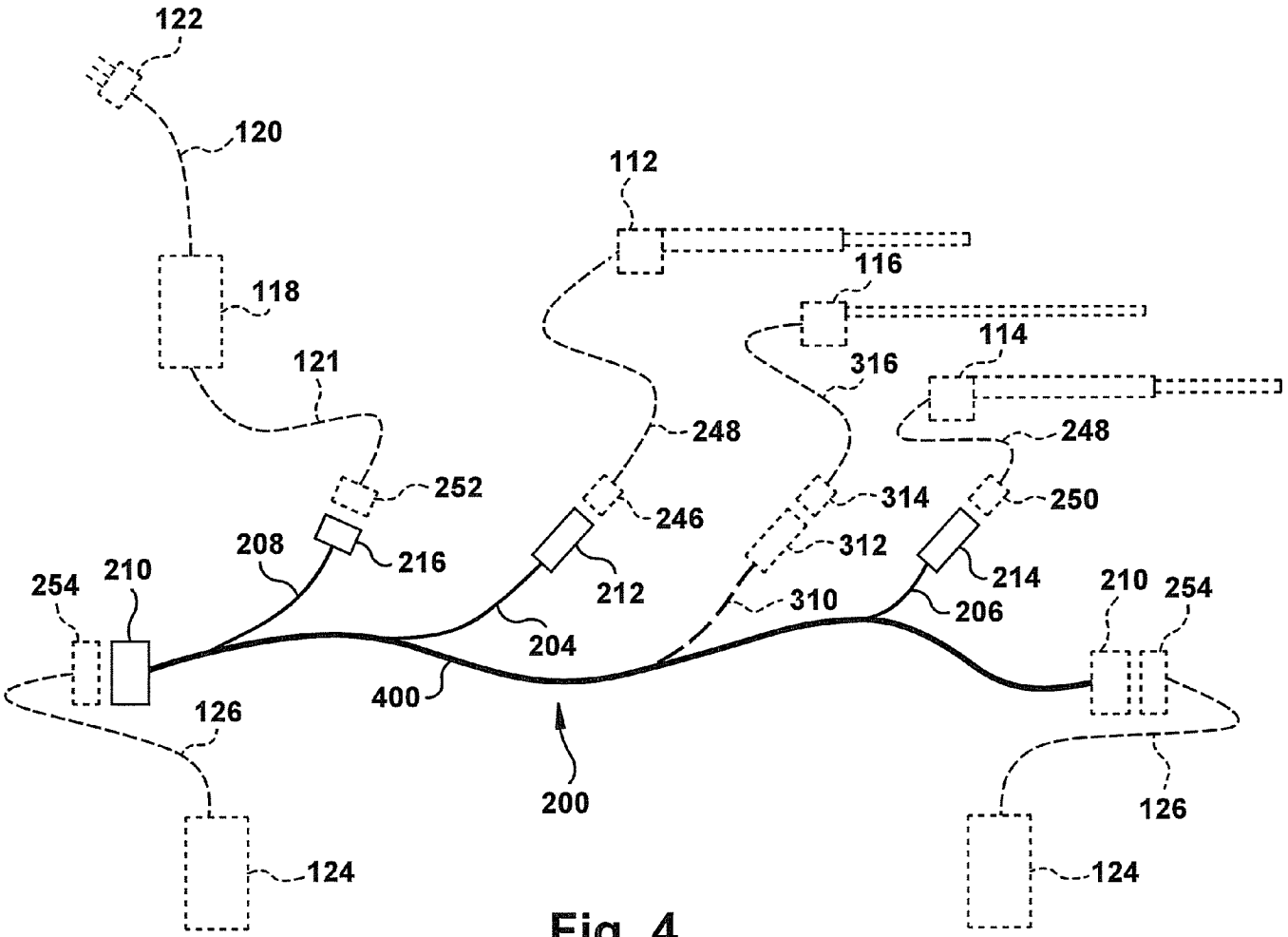
FIG. 4 is a diagram of one physical embodiment of the power and control system of the present invention.

Illustrated in FIG. 4, is one embodiment of power and signal distribution assembly 200. In this embodiment, assembly 200 is in the form of a flexible, insulated, multiple wire assembly having multiple input and output ports, as described in the previous embodiments. Also, the embodiment of FIG. 4 may include dual main bus ports 210 so that pendant controller 124 may be connected to either side (left or right) of the bed. The dual main bus ports 210 may be provided independent of whether or not assembly 200 includes optional bus 310 for the high-low bed function.

As shown in FIG. 4, power and signal distribution assembly 200 includes a main body portion 400 from which buses 204, 206, 208, and 310 (optionally) extend therefrom. In this embodiment, buses 204, 206, 208, and 310 (optionally) include flexible, insulated, multiple wire assemblies and each terminating at a port (e.g., 212, 214, 216, and 312 (optionally)). Such a configuration allows power and signal distribution assembly 200 to be lightweight and physically configurable to the geometry of the bed. Furthermore, the extension of buses 204, 206, 208, and 310 further provide flexibility connecting to the assemblies they are meant to provide power control signals thereto. The ports described herein can be any suitable mating connectors. In other embodiments, buses 204-208 and 310 can be integrated into the body portion 400 so as to not extend or minimally extend therefrom. Furthermore, in other embodiments, ports 212-216 and 312 can be integrated into body portion 400 so to also not extend or minimally extend therefrom.

As shown in FIG. 4, power and signal distribution assembly 200 includes a port 216 for accepting a DC voltage (e.g., 28 V DC) that is less than the typical wall outlet (90-130 V AC or 210-240 V AC). Assembly 200 further includes at least one controller port 210 for connecting power and control signal to and from a pendant controller. The power signals are preferably, but need not necessarily be, the same as those provided at port 216. Assembly 200 also includes a plurality of output ports 212, 214, and 312 for connecting to various devices such as motors/actuators for controlling a range of devices on the bed. In one embodiment, ports 212, 214, and 312 provide power control signals at the same voltage (e.g., 28 V DC) as that received at port 216 from the power supply 118. In this manner, a uniform, low voltage DC signal is brought to power and signal distribution assembly 200 that is mounted to the bed and used to control the bed. In other embodiments, multiple, low voltage DC signals may also be brought to power and signal distribution assembly 200 such as, for example, 5, 12, 24, and/or 28 V DC, or other DC voltages.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, power and signal distribution assembly can be in the form of a control or junction box instead of a flexible, multiple wire assembly. Also, additional motor/actuators may be provided. Furthermore, the number of ports may be more or less than those shown herein including, for example, multiple ports for power input and multiple ports for device control output. Still further, circuitry may be added which only allows for one motor/actuator to be run at a time. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A bed system comprising: a frame; a head spring and a foot spring coupled to the frame; one or more motors for adjustably moving the head or foot spring; and an assembly comprising: at least one power input port receiving a first DC voltage from a power supply, the power supply receiving an AC voltage and converting it to the first DC voltage; at least one controller port receiving the first DC voltage and outputting at least one power control signal having the first DC voltage; and at least one output port receiving power control signals having the first DC voltage, wherein the power control signals directly power the one or more motors; wherein the assembly comprises a first location and the power supply comprises a second location different from the first location; and wherein the controller port is disposed at a location on one side of the bed system and a second controller port is disposed at a location on the other side of the bed system, and wherein each controller port is connected to the at least one output port, and wherein each controller port outputs power control signals that are received by the at least one output port; wherein each controller port outputs user selectable power control signals that are received by the at least one output port.

2. The bed system of claim 1 wherein the second location of the power supply comprises a location remote from the frame.

3. The bed system of claim 1 wherein the first location of the assembly comprises a location on the frame and the second location of the power supply comprises a location remote from the frame.

4. The bed system of claim 1 wherein the power input port receives a second DC voltage from the power supply.

5. The bed system of claim 1 wherein the at least one power input port receives a plurality of DC voltages from the power supply.

6. The bed system of claim 1 wherein the assembly further comprises a multiple, insulated, wire body.

7. The bed system of claim 1 wherein the assembly comprises a plurality of multiple, insulated, wire sub-assemblies extending from a main body comprising a multiple, insulated wire assembly.

8. An assembly for signal distribution on a bed comprising:

at least one power input port receiving a first DC voltage from a power supply, the power supply receiving an AC voltage and converting it to the first DC voltage;

at least one a controller port receiving the first DC voltage and outputting at least one power control signal having the first DC voltage;

at least one output port receiving signals having the first DC voltage;

wherein the assembly comprises a first location and the power supply comprises a second location different from the first location; and wherein the assembly is configured such that the controller port is disposed at a location on one side of the bed and a second controller port is disposed at a location on the other side of the bed, and wherein each controller port is connected to the at least one output port, and wherein the second controller port and the at least one output port have a common power control signal line for transmission of the power control signals from the second controller port to the at least one output port.

9. The assembly of claim 8 wherein the power input port receives a second DC voltage from the power supply.

10. The assembly of claim 8 wherein the power input port receives a plurality of DC voltages from the power supply.

11. The assembly of claim 8 further comprising a multiple, insulated, wire body connected to the power input port, controller port and at least one output port.

12. The assembly of claim 8 further comprising a plurality of multiple, insulated, wire sub-assemblies extending from a main body comprising a multiple, insulated wire assembly to the at least one power input port, controller port, and output port.

13. The assembly of claim 8 wherein each port outputs at least one signal comprising the first DC voltage.

14. The assembly of claim 8 wherein each port comprises a first connector.

15. A bed system comprising:

a frame;

a head spring and a foot spring coupled to the frame;

one or more motors for adjustably moving the head or foot spring;

an assembly comprising:

a power input port configured to receive a DC voltage;

a first controller port configured to receive the DC voltage from the power input port and output a first power control signal having the DC voltage;

an output port configured to receive the first power control signal from the first controller port;

a second controller port configured to receive the DC voltage from the power input port and output a second power control signal having the DC voltage to the output port associated with the first controller port; and wherein the first controller port is disposed proximate a first side of the bed system and the second controller port is disposed proximate a second side of the bed system, and wherein the first and second power control signals directly power the one or more motors.

16. The bed system of claim 15, wherein the first and second power control signals are user selectable power control signals.

17. An assembly for signal distribution on a bed comprising:

a power input port configured to receive a DC voltage;

a first controller port configured to receive the DC voltage from the power input port and output a first power control signal having the DC voltage;

an output port configured to receive the first power control signal from the first controller port;

a second controller port configured to receive the DC voltage from the power input port and output a second power control signal having the DC voltage to the output port associated with the first controller port; and wherein the assembly is configured such that the first controller port is disposed proximate a first side of the bed and the second controller port is disposed proximate a second side of the bed, and wherein the second controller port and the output port have a common power control signal line for transmission of the second power control signals to the output port.

18. A power and signal distribution assembly for a bed comprising:

an input power bus comprising a flexible, insulated, multiple wire sub-assembly having a first DC voltage power line;

an input power port for receiving the first DC voltage from a power supply;

a controller bus comprising a flexible, insulated, multiple wire sub-assembly having a plurality of control signal output lines for carrying the first DC voltage; a first controller port disposed on the controller bus wire sub-assembly; a second controller port disposed on the controller bus wire sub-assembly;

at least one output bus comprising a flexible, insulated, multiple wire sub-assembly having a plurality of control signal lines for carrying the first DC voltage; and wherein the assembly comprises a first location and the power supply comprises a second location remote from the first location; and wherein the first and second controller ports and the at least one output bus have common control signal lines for transmission of control signals from the first and second controller ports to the at least one output bus.

19. The assembly of claim 18 wherein the input power bus wire sub-assembly extends from the controller bus wire sub-assembly to form a physical extension separate from the controller bus wire sub-assembly.

20. The assembly of claim 18 wherein the at least one output bus wire sub-assembly extends from the controller bus wire sub-assembly to form a physical extension separate from the controller bus wire sub-assembly.

21. The assembly of claim 18 wherein the assembly is configured such that the first controller port is disposed at a first side of the bed and the second controller port is disposed at a second side of the bed, and wherein each controller port is connected to the at least one output bus.

* * * * *